US008887977B2

(12) United States Patent
Ralph

(10) Patent No.: US 8,887,977 B2
(45) Date of Patent: Nov. 18, 2014

(54) MAGAZINE CARRIER

(71) Applicant: Douglas Ralph, Brookville, IN (US)

(72) Inventor: Douglas Ralph, Brookville, IN (US)

( * ) Notice: Subject to any disclaimer, the term of this patent is extended or adjusted under 35 U.S.C. 154(b) by 253 days.

(21) Appl. No.: 13/659,428

(22) Filed: Oct. 24, 2012

(65) Prior Publication Data

US 2014/0110443 A1 Apr. 24, 2014

(51) Int. Cl.
*F42B 39/02* (2006.01)

(52) U.S. Cl.
USPC ..... 224/666; 224/245; 224/247; 224/931

(58) Field of Classification Search
CPC ..... F42B 39/02; Y10S 224/931; A45F 220/0591; A45F 5/02
USPC ..... 224/239, 245, 242, 247, 666, 671, 675, 224/931
See application file for complete search history.

(56) References Cited

U.S. PATENT DOCUMENTS

| | | | | |
|---|---|---|---|---|
| 1,756,677 | A * | 4/1930 | Cook | 224/245 |
| 6,154,997 | A * | 12/2000 | Aluotto et al. | 42/90 |
| 7,614,534 | B2 * | 11/2009 | Veo et al. | 224/196 |
| 8,322,065 | B2 * | 12/2012 | Faifer | 42/90 |
| 8,485,405 | B2 * | 7/2013 | Crye | 224/666 |
| 2008/0105722 | A1 * | 5/2008 | Howell | 224/671 |

* cited by examiner

*Primary Examiner* — Brian D Nash
*Assistant Examiner* — Corey Skurdal
(74) *Attorney, Agent, or Firm* — Roberts IP Law; John Roberts

(57) ABSTRACT

A munitions carrier. The carrier securely retains a magazine and provides for rapid deployment of the magazine. The carrier is box-like and has one or more open ends. Four faces are sized and shaped to engage the four longitudinal faces of a magazine. The carrier has inside contours which can engage a complementary area of the outfeed end of a magazine. The carrier made from a material is flexible and has memory for returning to a configuration for retaining a magazine. At least two faces are discontiguous with each other and can be separated from each other. A retained magazine can be disengaged from the carrier and rapidly deployed if a multi-vectored force is applied to the magazine.

19 Claims, 11 Drawing Sheets

MAGAZINE CARRIER

BACKGROUND OF THE INVENTION

This invention relates to a device for carrying a munitions magazine. Important features in a magazine carrier include the ability to keep the magazine and munitions therein secure to a wearer via attachment to a MOLLE garment or belt.

Other magazine carriers have included various pouch-type carriers. The pouches typically include a covering or lid that is secured with a fastener such as a snap, hook and loop closure, bungee cord, or buckle, etc. When pouch-type carriers are worn, the outfeed end of a magazine is typically positioned at the bottom of the pouch or toward the feet of a wearer. These types of carriers require opening the pouch, removing the magazine, reorienting the magazine within the hand of the shooter, and inserting the magazine into a weapon before the magazine's ammunition can be prepared for firing. Each step in this process presents sources for user-error when performed rapidly or during the increased stress of a fire-fight or a timed competition.

Another type of magazine carrier includes structures that mimic the four faces and latch of a weapon's receiver-well. The magazine is precisely aligned with the carrier and inserted so that a locking mechanism in the carrier engages the magazine's recessed area. The locking mechanisms typically include multiple moving parts so that the locking mechanism of the carrier may be selectively engaged or disengaged from the magazine. The moving parts may become worn, damaged or inoperable over time. To prepare the magazine for firing, the wearier needs to disengage the locking mechanism while simultaneously controlling the magazine, remove the magazine linearly from the carrier, and orient the magazine for insertion into the weapon's receiver-well. This process presents opportunities for user error.

Another type of carrier holds a magazine in compression. This type of carrier requires a trade-off between retention and accessibility. The tighter the magazine is held in compression, the more securely the magazine is retained, but the stiffer the draw. Rapid accessibility is diminished when the magazine is held in tight compression. A magazine may be held under less compression by a carrier to allow easier access and quicker draw, but the magazine is less securely retained and subject to falling out. The compression can be adjustable with a screw or by altering an elastic coupling to provide for greater retention or greater access depending on a user's preferences, but the preferred setup may be elusive as there is very little tolerance between an acceptable setup and an unsatisfactory setup.

Previous carriers have required two hands to operate, required a complex process to weaponize the magazine, required careful dexterity to remove the magazine from the carrier and orient it for loading into a weapon, required a tradeoff between retention and rapid accessibility, and have been made of multiple moving parts which are subject to degradation and add complexity to the carrier. What is needed is a magazine carrier that overcomes one or more of these issues.

SUMMARY OF THE INVENTION

An aspect of the invention includes a magazine carrier with a first face and a second face that is substantially perpendicular to the first face. The carrier also includes a third face that is substantially perpendicular to the second face, and the carrier includes a fourth face that is substantially perpendicular to the third face. One of the faces is contiguous with two other faces, and two of the faces are contiguous with only one other face. The faces form a rectangular structure that has two faces that are separable. The faces cooperate to carry a munitions magazine.

Another aspect of the invention includes a munitions supply system that has a munitions magazine with a recess that receives a weapon's retaining latch. The system also includes a flexible magazine carrier that releasably couples the magazine. The magazine carrier has four sides shaped to substantially and closely surround the magazine. The perimeter defined by the four sides has a break point where the sides are discontiguous. The carrier has a detent that extends from one of the sides into the interior space of the carrier and into the munitions magazine recess. The travel path of the detent can occur along more than one detent travel path as the four sides flex. The detent and the four sides are of a unibody construction formed from a material that has shape memory. The detent and four sides cooperate to retain the magazine.

DETAILED DESCRIPTION OF THE PREFERRED EMBODIMENTS

Figure 1:
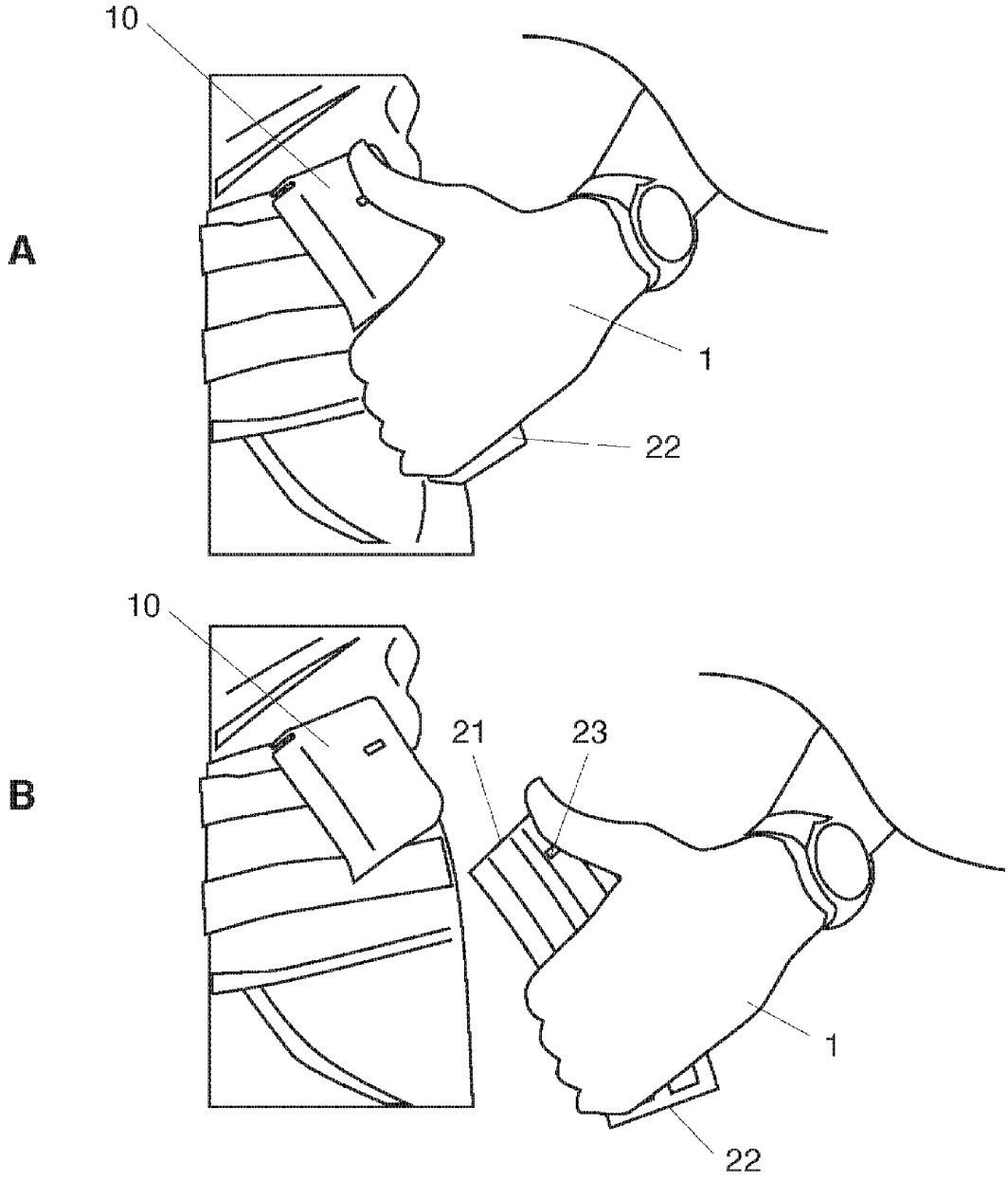
FIG. 1 shows the carrier affixed to a marksman's hip. A magazine is retained in FIG. 1A and controlled by a marksman in FIG. 1B.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

FIG. 1 shows an embodiment of a magazine carrier 10 structurally configured to allow a user or marksman 1 to rapidly deploy a magazine 2. The carrier 10 is box-like and receives and retains the outfeed end 21 of a magazine. The carrier maybe affixed to a MOLLE device, belt, or similar retaining garment in an orientation that retains the magazine so that a marksman may employ essentially the same hand grasp around the magazine to initially control the magazine 2, eject it 2 from the carrier, and insert it 2 into a weapon.

FIG. 1A shows the carrier 10 affixed to a retaining garment at the marksman's left hip where the magazine 2 is retained. To disengage the magazine from the carrier, the marksman 1 may grasp the lower end 22 of the magazine with the left hand and pull the magazine back and to the left, away from the hip. That disengaging motion causes the carrier to flex and release the magazine.

FIG. 1B shows the magazine 2 free of the carrier 10 and within the grasp of the marksman 1 after the disengaging motion has been employed. The marksman's grasp on the lower end 22 of the magazine need not change to insert the outfeed end 21 of the magazine into a weapon's receiving well. Furthermore, the marksman's grasp may position the thumb to press the weapon's bolt release immediately after the magazine has been inserted. The magazine can be transitioned from being retained on the marksman's hip to being fire-ready with minimal repositioning of the magazine within the marksman's hand.

Figure 2:
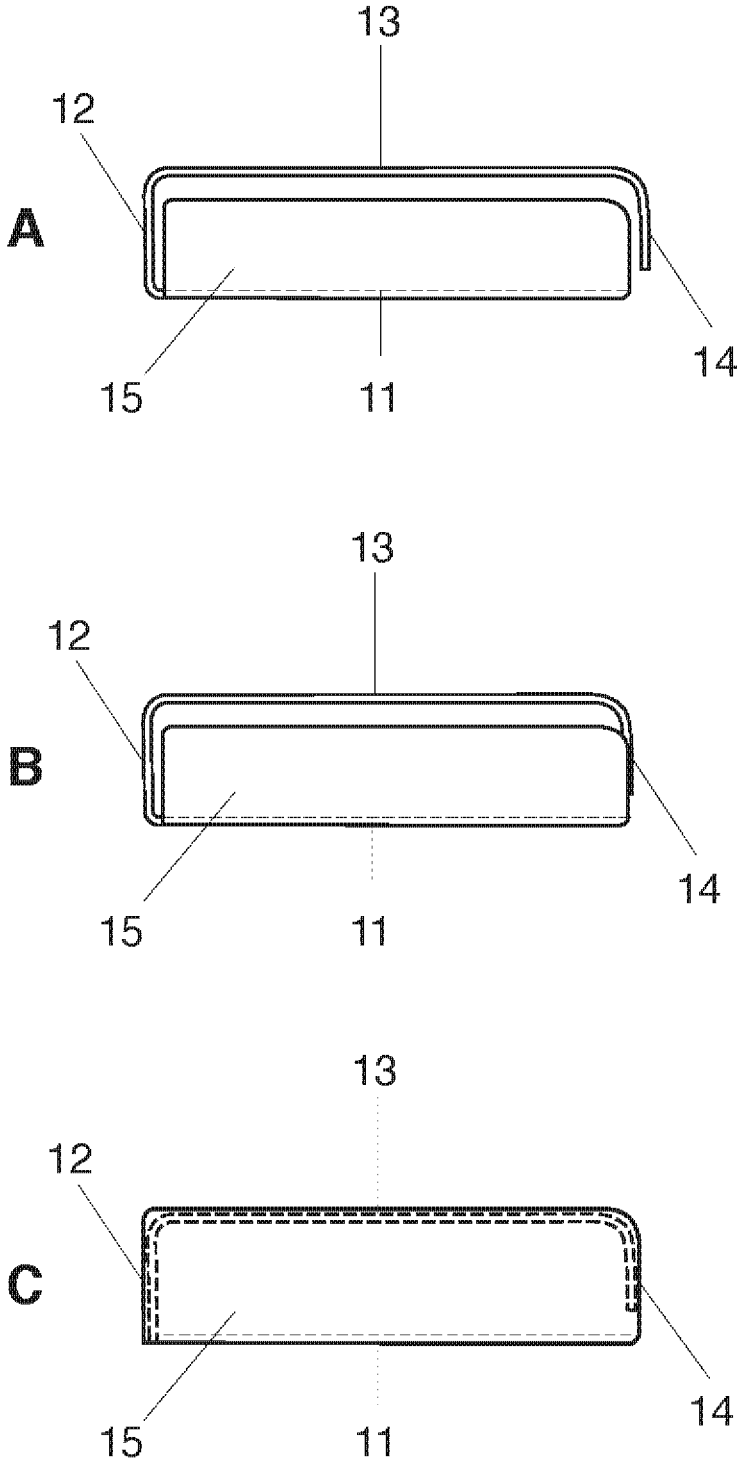
FIG. 2A-C show top views of embodiments of the carrier having different sized tops.

FIG. 2 shows various embodiments of the carrier which has a first face 11 which is substantially perpendicular to and contiguous with a second face 12. The second face 12 is substantially perpendicular to and contiguous with a third face 13 and the first face 11. The third face 13 is substantially parallel with the first face, substantially perpendicular to and contiguous with a fourth face 14 and the second face. The fourth face 14 is substantially perpendicular to and contiguous with the third face, and the fourth face is substantially perpendicular to the first face, but is not contiguous with the first face. The four faces of the carrier oppose and abut the four lateral surfaces of a magazine retained by the carrier and form a box-like structure around the outfeed end of the retained magazine.

The carrier 10 may also have a top face 15 that is contiguous with the first face and noncontiguous with the other faces. Embodiments 2A, 2B, and 2C show variations in the size of the top face. The top face may be disjoined from the second, third, and fourth faces as in 3A so that a small gap exists between them. Alternatively, the top face may closely abut one of the faces 12-14 as in 3B. In another embodiment 3C the top face may closely abut each of the faces 12-14 and may have a width as great or greater than the span between opposing faces 11 and 13 and a length as great or greater than the span between opposing faces 12 and 14. The top may closely and tightly abut the faces to minimize exposure of the retained magazine to dirt.

The faces 11-14 of the carrier 10 have one or more features on the inside surface 30 that engage and retain the magazine 2. Nearly all magazines have an engagement area designed to cooperate with a magazine retaining latch in the receiving well of a firearm. Many magazines have a rectangular recess that serves the purpose of retention within the firearm.

Figure 3:
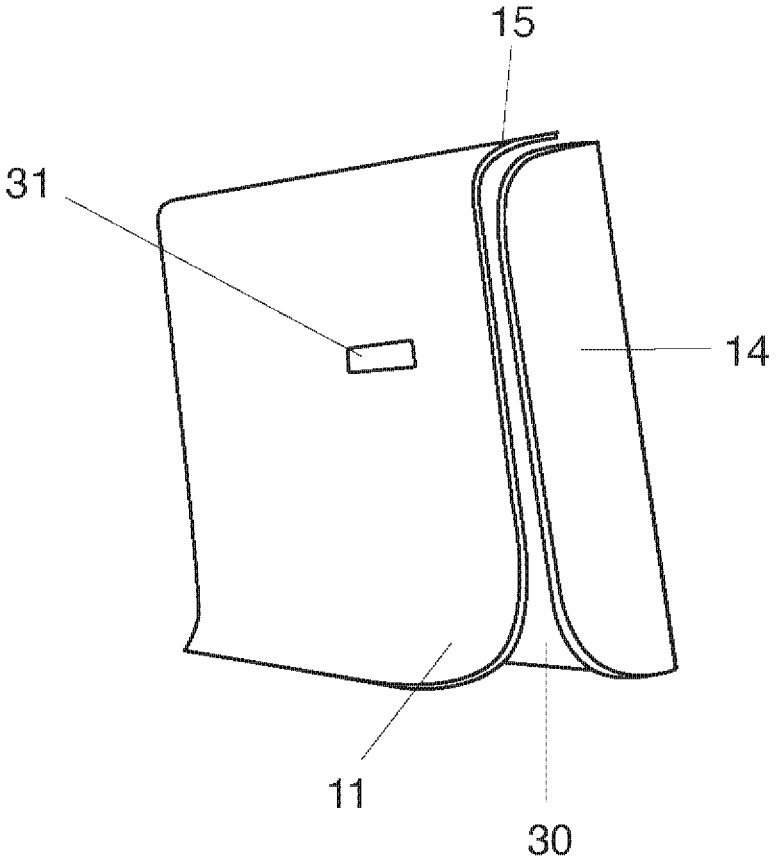
FIG. 3 shows an embodiment of the carrier having a detent.

The carrier 10 of FIG. 3 has a detent 31 projecting from the first face toward the third face. The carrier's detent can engage the recessed area 23 of a magazine, and the detent can at least partially protrude into a magazine's recessed area. FIG. 3 also illustrates that the first face 11 and fourth face are noncontiguous with each other. The faces 11, 14 may be in contact and may closely abut each other to minimize exposure to dirt and sediments. The noncontiguous faces 11, 14 are readily separable from each other without destruction or alteration of the carrier's functionality.

Figure 4:
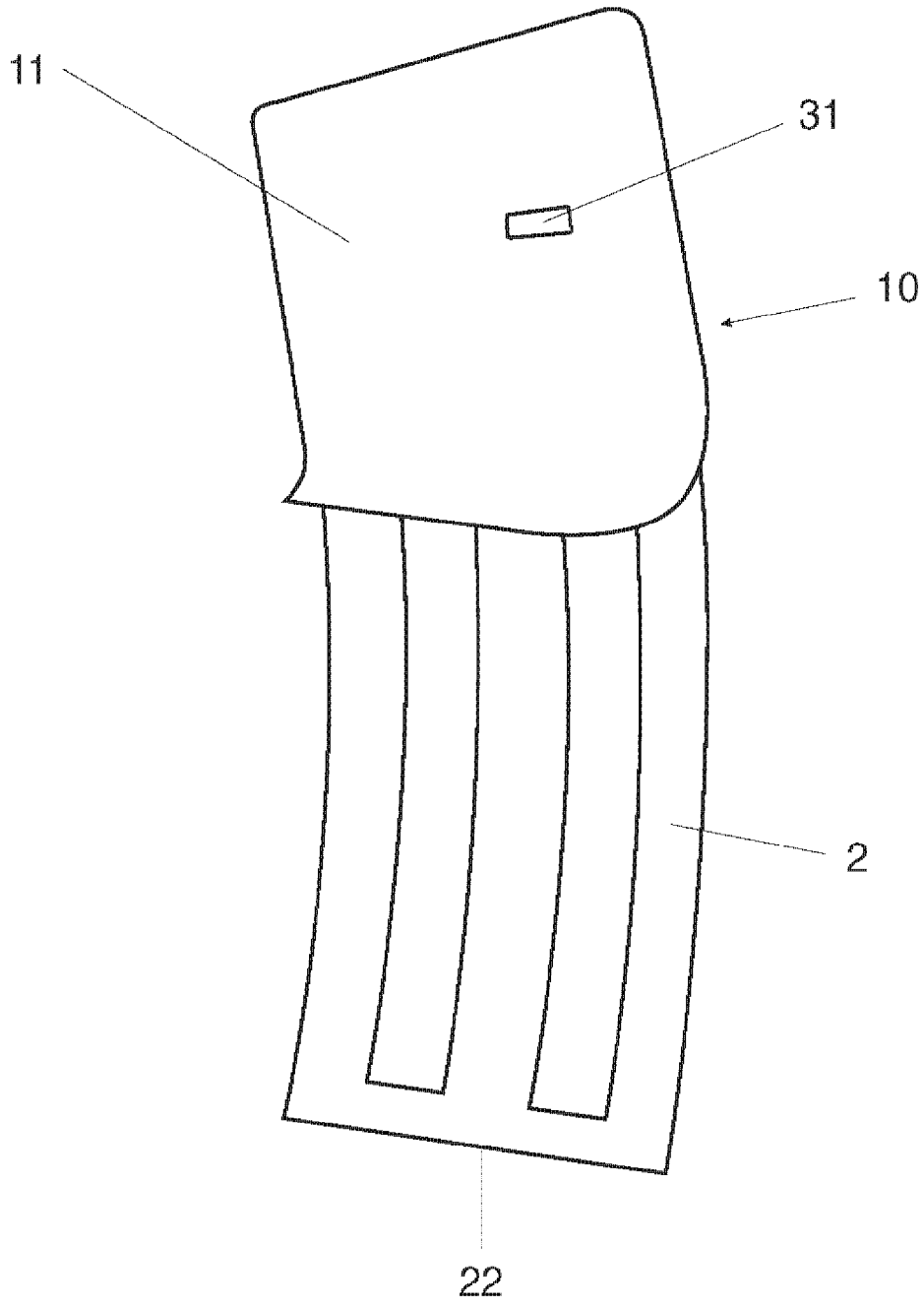
FIG. 4 shows a magazine being retained by a carrier having a detent.

FIG. 4 shows a carrier 10 retaining a magazine 2. The carrier's detent portion 31 engages a recessed area 23 on a magazine. The detent portion 31 and the recessed area of the magazine are aligned and engaged with each other for the purpose of retention. The carrier may have one detent on a first face or multiple detents may be positioned on multiple faces.

Figure 5:
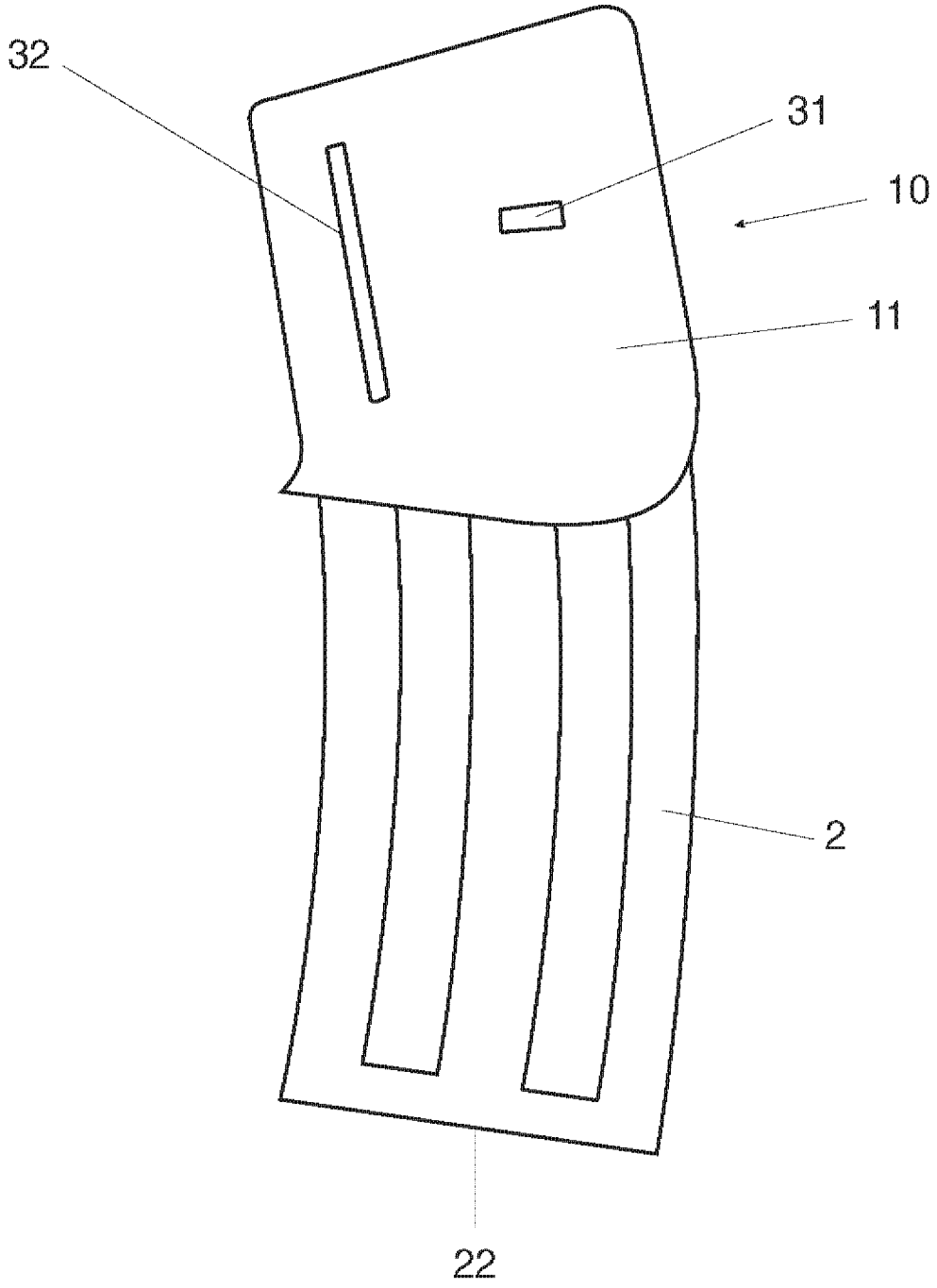
FIG. 5 shows a magazine being retained by a carrier having a detent and a ridge.

Magazines may have another recessed area that is longitudinal. As shown in FIG. 5, a carrier 10 may have a ridge 32 that engages the longitudinal recessed area or areas of a magazine. The longitudinal ridge of the carrier may project toward and engage with the longitudinal recessed area of a magazine and further retain the magazine. The ridge may be on a first face only or multiple faces may have one or more ridges. For example, a ridge may be on each of the first and third faces.

Different embodiments of the carrier can be made to engage the various shapes and designs of various magazines. Some magazines have overhanging portions which are not flush with the outer surface of a magazine. For example, AK-47 magazines may have overhanging portions, and a carrier may have an internal feature which is complementary to the overhanging portion to provide another retention point. The magazine's complementary feature may be a projection like a shelf, tab, detent, ridge, etc. and the complementary feature is shaped to engage and support the overhanging portion from at least one direction. In some embodiments the carrier's complementary feature may be a recessed area which receives the magazine's overhanging portion and supports it from more than one direction. One or more faces may have a complementary feature for engaging the overhanging portion of a magazine, and a complementary feature may span more than one face. For example, a complementary feature may be positioned in a corner and at least partially span the two faces thereof.

Figure 6:
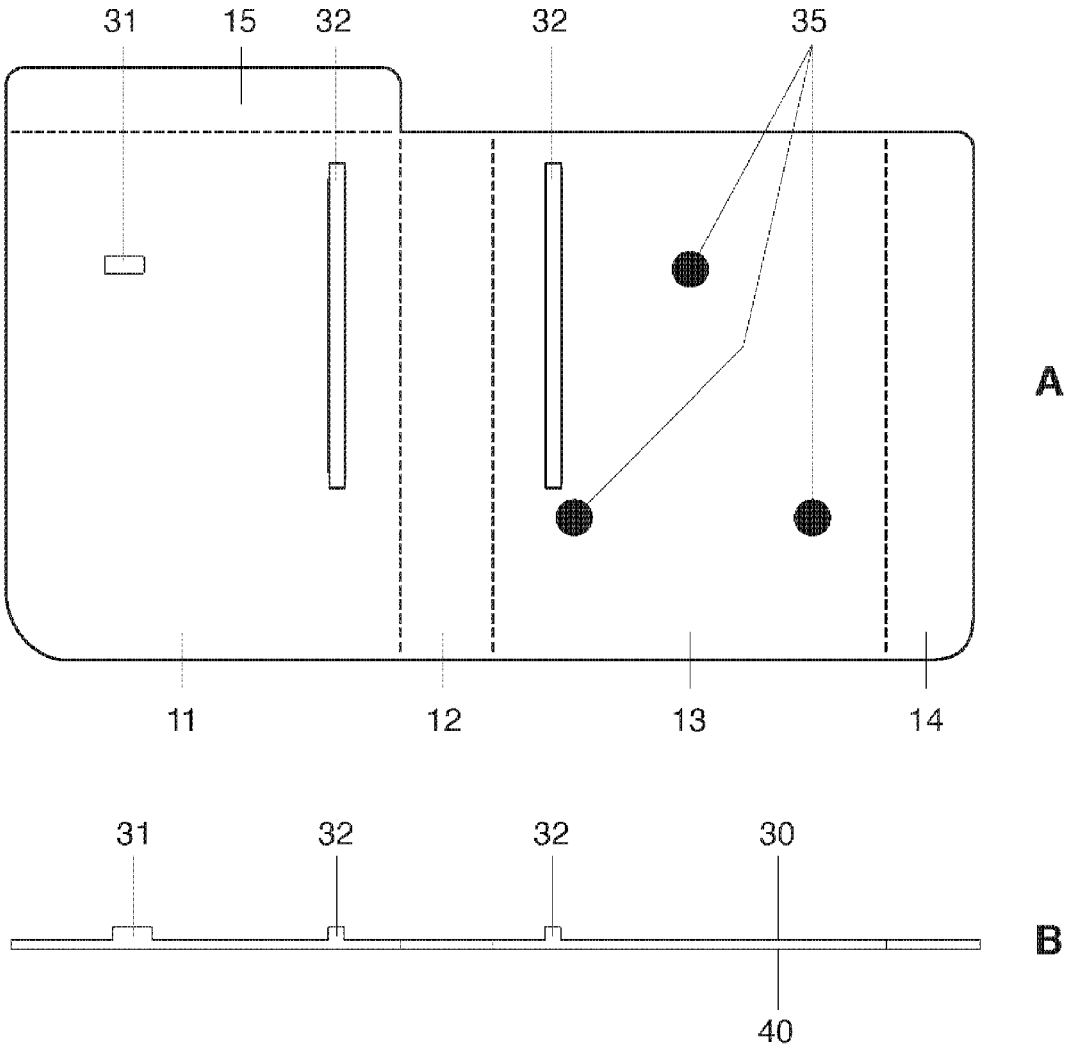
FIG. 6A-B show an exploded or unfolded views of a carrier.

FIG. 6 illustrates the carrier in a flattened or unfolded view. FIG. 6A is the broadside view of the carrier and FIG. 6B is the profile view. In this embodiment the first face 11 is contiguous with the top 15 and only contiguous with one of the other faces, i.e., the second face. The second face 12 is contiguous with the first and third faces. The third face 13 is contiguous with the second and fourth faces. Finally, the fourth face 14 is only contiguous with the third face. The carrier has a detent 31 and ridges 32 which project from the inner surface of the magazine carrier and engage corresponding areas on a magazine.

The carrier may contain holes 35 for receiving a mounting device which can affix the carrier to a belt or MOLLE garment. The embodiment of FIG. 6 has three holes 35, but the number of holes and position of the holes can vary. Some embodiments may have only one mounting hole, other embodiments may have two holes, while some embodiments may have four or more holes. In some embodiments, the multiple holes may be arranged in a circular pattern.

Figure 7:
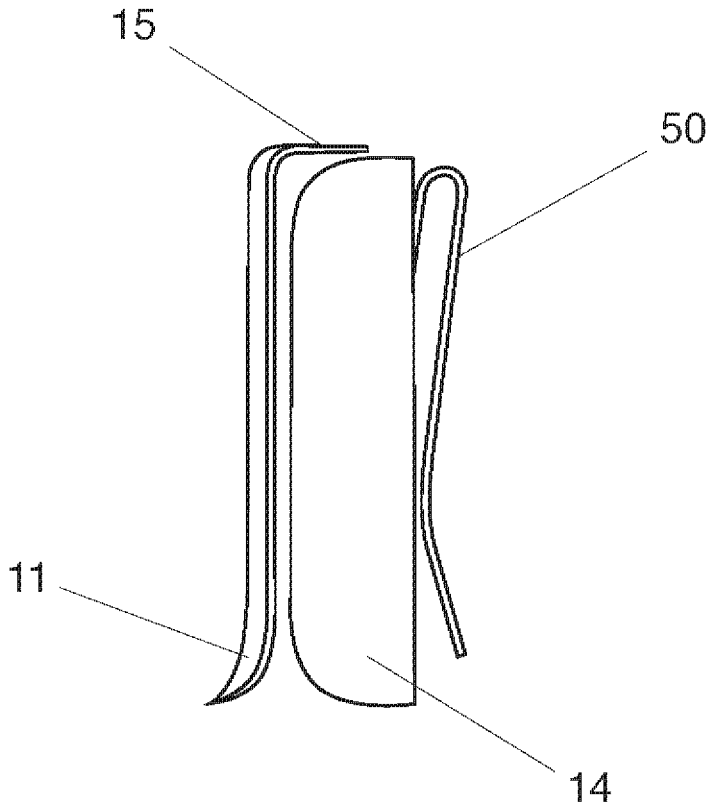
FIG. 7 shows a carrier having a mounting stick fastened thereto.

FIG. 7 shows a mounting stick 50 fastened to a carrier 10. The mounting stick 50 is engagable with a belt or MOLLE garment. A mounting stick may be affixed to one of the faces of the carrier with a fastener 45 such as screw and bolt, a rivet, or other semi-permanent securing means which can keep the mounting stick and a face of the carrier secured together.

In some embodiments adjustments can be made by unscrewing or unfastening the fastener and repositioning the mounting stick. This can allow the carrier to be affixed to a marksman at various positions and still allow the marksman disengage the magazine from the carrier using a sweeping technique preferred by the marksman.

Figure 8:
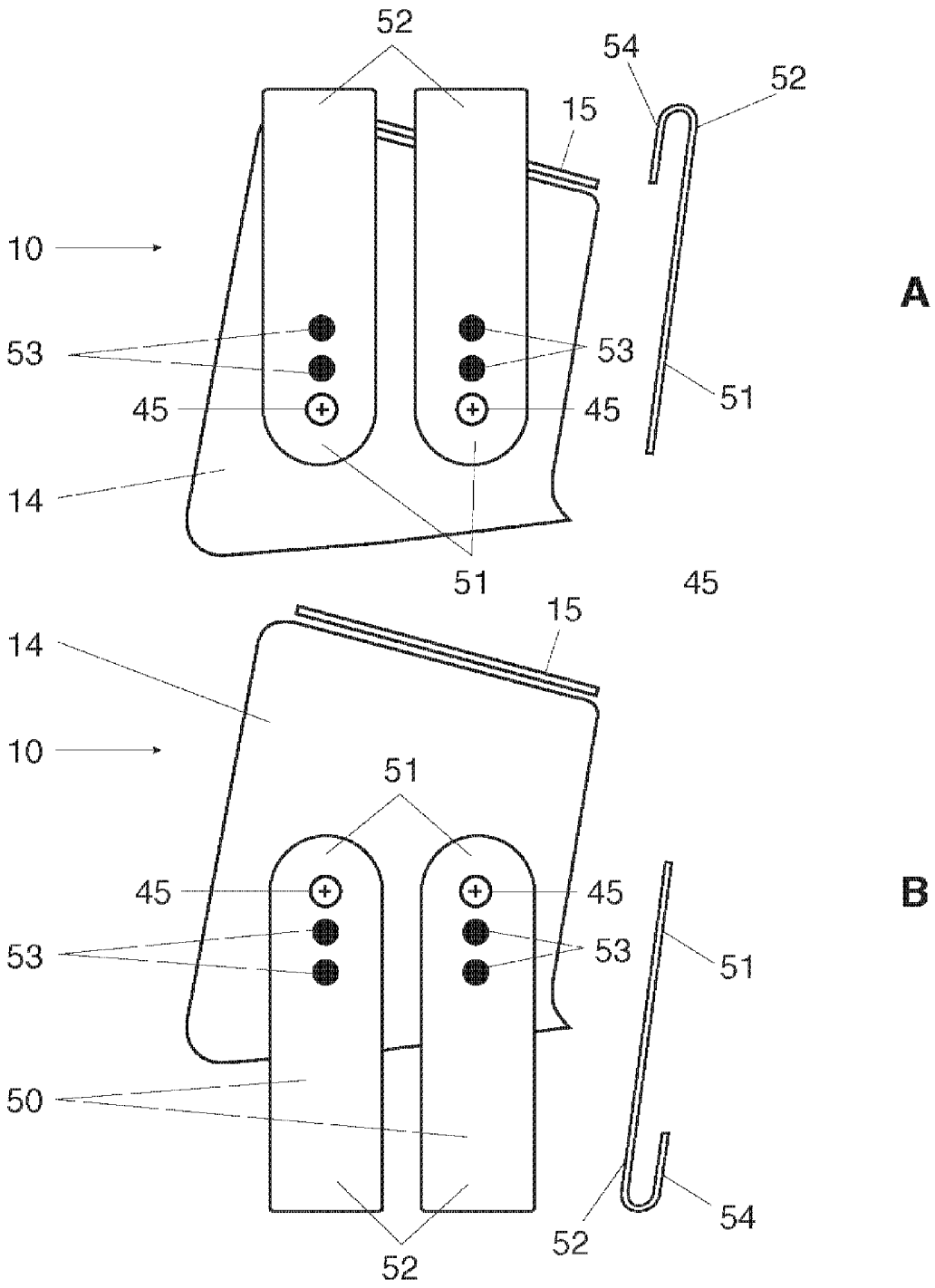
FIG. 8A-B show a magazine carriers having mounting sticks variably fastened thereto.

A mounting stick 50 may be repositionable as shown in FIG. 8. The mounting stick 50 has a first end 51 and a second end 52. The first end 51 may have a hole 53 or holes 53 which are alignable with the carrier holes 35 and through which a fastener 45 may pass and secure the pieces 10, 50 together. A mounting stick with multiple holes provides versatility as to how the mounting stick can attach to belts of various widths and accommodates for other marksman preferences.

FIG. 8A illustrates the second end 52 of the mounting stick 50 positioned near the top 15 of the carrier, and FIG. 8B illustrates the second end positioned opposite of the top end 15. Fasteners 45 (Phillips-head screws shown) pass through the carrier holes 35 and through mounting stick holes 53 and secure the mounting stick and carrier together.

The second end 52 may have a means 54 for engaging with a belt or MOLLE garment. The means may include a hook, wedge, enlarged area, or other structure which complements the garment to which the carrier can attached.

In some embodiments the carrier holes 35 and or mounting stick holes 53 may be threaded so that a screw may engage with the threads formed integrally in a face of a carrier or in the mounting stick. Alternatively a bolt may engage with the screw to secure the pieces 10, 50 together between the bolt and a screw-head.

In other embodiments the mounting stick 50 and a face of the carrier 10 are permanently secured together and cannot be separated without damaging the carrier. The mounting stick and the carrier my be contiguous with each other and may together be of unibody construction.

Figure 9:
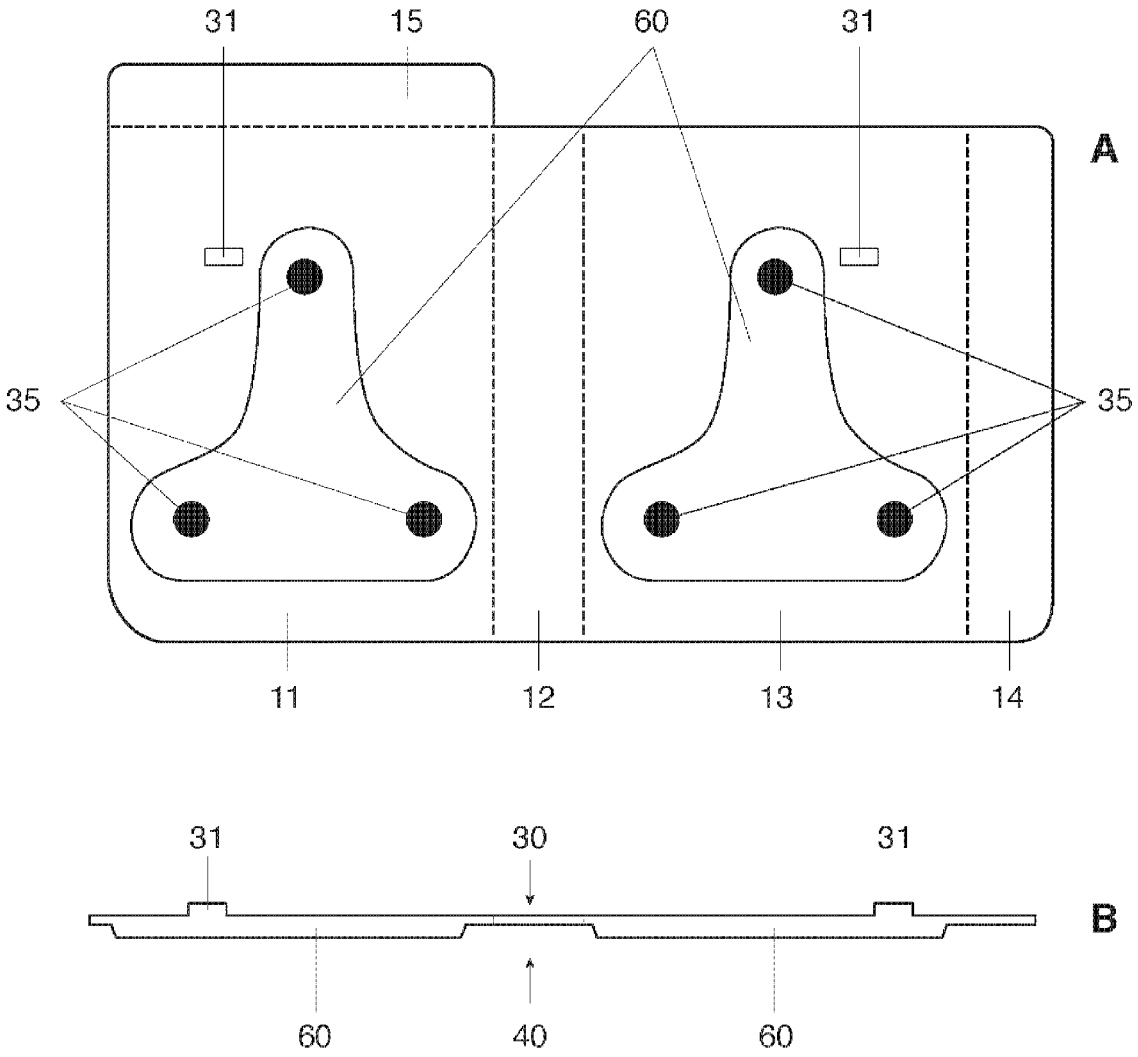
FIG. 9A-B show a an exploded or unfolded views of a carrier having recessed areas.

FIG. 9 shows another embodiment in a flattened or unfolded view. FIG. 9A is the broadside view and FIG. 9B is the profile view. This embodiment has mounting holes 35 on two opposing faces, e.g., the first face 11 and the third face 13. The first and third faces can each have a detent 31 which can engage the recessed area 23 of a magazine.

The mounting holes 35 are in recessed portions 60 of the first and third faces. The recessed portions are offset from the interior. A fastener engaging a recessed mounting hole is also offset from the interior. The recessed portion 60 and the fastener may be selected so that the fastener does not interfere with a retained magazine 2. This arrangement can minimize or eliminate contact between the fastener and the magazine so that the fastener does not damage the magazine and so that rapid deployment of the magazine will not be interfered with by the fasteners.

The embodiment of FIG. 9 has mounting holes 35 on opposing faces 11, 13. The mounting holes on either face can be used for fastening a mounting stick. Embodiments with mounting holes 35 on opposing faces have greater versatility for where the carrier is placed on a marksmen and can provide for mirror-image positioning and functionality for left and right-handed users.

Figure 10:
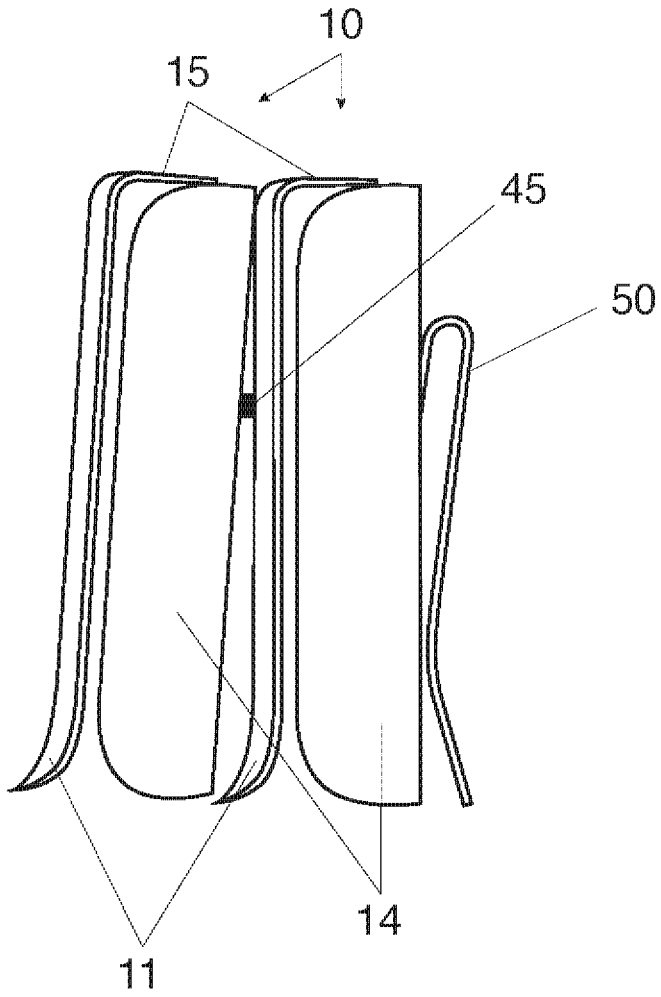
FIG. 10 shows two carriers fastened together.

A carrier 10 with mounting holes on more than one face may be fastened to another carrier 10 as shown in FIG. 10. Two or more carriers can be secured together using a fastener 45.

The carriers have a flared-out bottom. The flared bottom provides a larger target for insertion of the magazine 2 into the carrier. The lower end can receive a magazine from multiple trajectories and guide it 2 into alignment with the faces 11-15.

Magazines inserted into carriers having at least one flared bottom are not parallel. The lower ends 22 of the nonparallel magazines are separated. This arrangement can provide greater ease in grasping a first magazine without contacting, disrupting, or needing to distinguish a second magazine. A marksman's hand can rapidly and individually grasp each lower end of multiple magazines with minimal or no repositioning of a magazine 22 as it 22 is transitioned from retained to weaponized.

In some embodiments a carrier 10 may be of a unibody construction. The carrier's faces 11-14, top 15, and possible features 30-32, 35, 40, and 60 of the carrier 10 may be formed from a single piece of material shaped into a structure for magazine retention. Each face and feature is physically and structurally contiguous with another face or feature as exemplified in FIGS. 6 and 9

Unibody construction can also include formation, manufacture, or construction techniques that initially construct individual faces or features as separate pieces but subsequently assemble the pieces and form a carrier bonded, fastened, or fixed together as a single unit for carrying a magazine and where each face and feature is thereafter physically contiguous with another face or feature.

Figure 11:
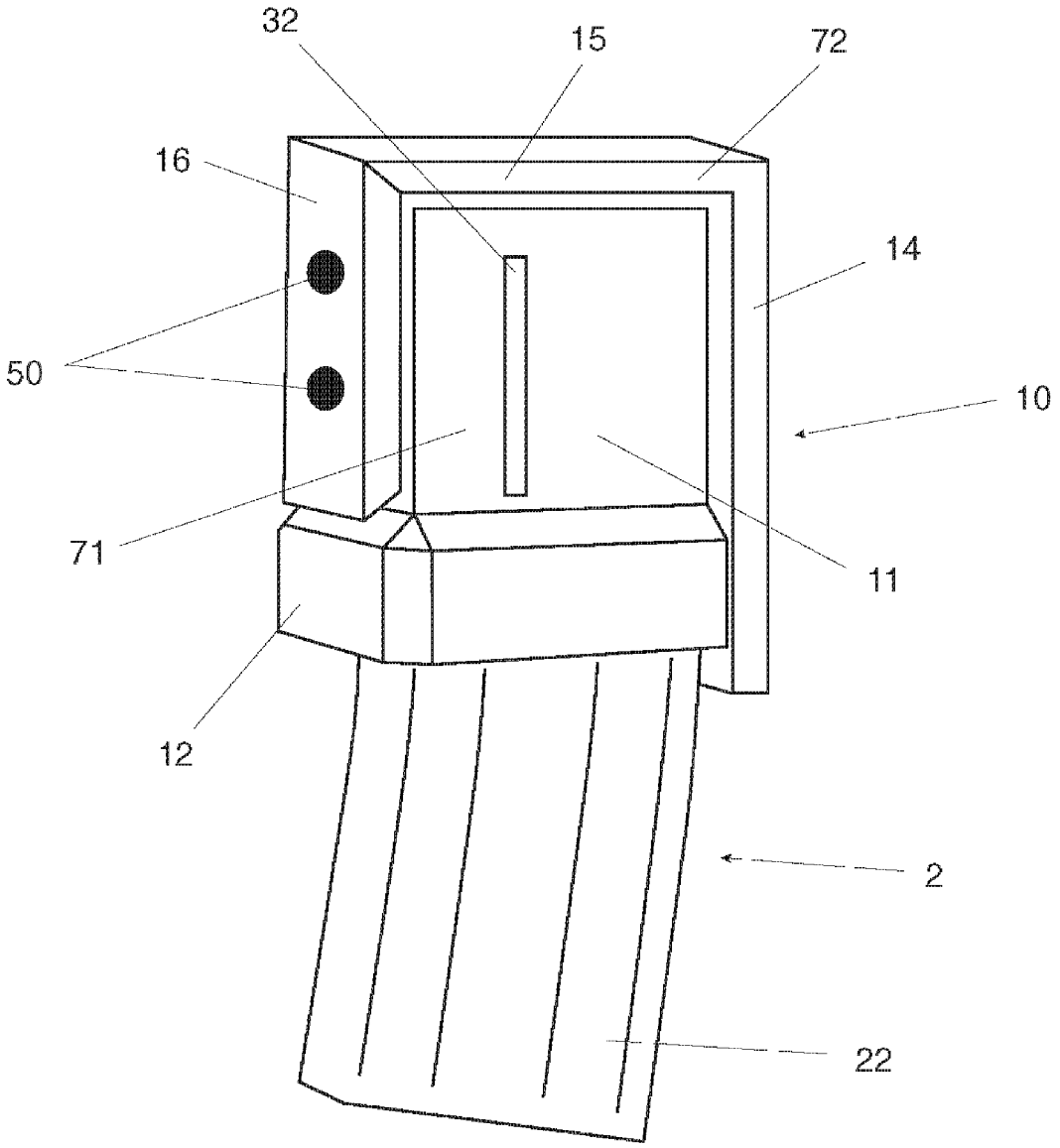
FIG. 11 shows a magazine retained by a carrier that has been constructed from two separate pieces.

The carrier of FIG. 11 is formed of a first piece 71 and a second piece 72. The first piece 71 includes first, second, and third faces 11-13. The first face 11 is contiguous with the second face 12. The second face is contiguous with the first face and a third face 13. The third face is contiguous with the second face.

The second piece 72 includes a forth or rear face 14, a top 15, and a front face 16. The front face 16 is contiguous with the top 15. The top is contiguous with the front face and the rear face 14. The rear face is contiguous with the top.

The first and second piece 71, 72 can be secured together. The second face 12 of the first piece and the front face 16 of the second piece each have holes which can be aligned to secure the pieces 71, 72 together with a fastener thereby making second face 12 and the front face 16 physically contiguous. As such, the second and front faces secured together can collectively be referred to as the second face 12 for the purpose of describing their orientation relative to the other faces 11, 13-15 of the carrier. Multiple carriers may be connected together by aligning the holes of each respective carrier and affixing a fastener therethrough. For example, a carrier may have holes on the second and fourth faces to receive a fastener for connecting a similar carrier.

The assembled carrier 10 of FIG. 11 has a first face 11 which is contiguous with a second face 12. The second face is contiguous with the first face 11, third face 13, and a top 15. The third face is contiguous with the second face. The top is contiguous with the second face and a rear face 14. The rear face is contiguous with the top. This arrangement can be duplicated in a carrier having unibody construction that does not require subsequent assembly, i.e., the top is physically and structurally contiguous with the second face.

A carrier may be made from a wide variety of materials including metals or plastics or the combination. The carrier may be formed from a thermoplastic. The carrier may be formed from nylon, polyethylene, polypropylene, polyvinyl chloride, polyurethane, polycarbonate, polyethylene, polypropylene, or other similar material which has memory and retains its shape. The material should be rigid so as to retain a magazine, but should be able to flex without destruction to the carrier so that a magazine may be disengaged. The material should have memory for an orientation which retains a magazine and allows the sides to return to a configuration for magazine retention after the sides have been flexed.

The detent 31 which engages the recessed area 23 of a magazine may be a wedge. The small end of the wedge is closer to the open end or bottom end of the carrier. A magazine being inserted into the carrier will first contact the small end of the wedge. As the magazine is inserted further and engages further with the wedge, the carrier flexes and the faces of the carrier are spread due to displacement of the wedge by the magazine. The memory of the material from which the carrier is made will bias the wedge to return to its position prior to displacement by the magazine. Complete insertion of the magazine into the carrier will result in the large end of the wedge aligning with the recessed area of the magazine. The detent wedge will be received by the recessed area of the magazine due to the material's bias to return to the pre-displacement position. The large end of the wedge is big enough to block the magazine from being dislodged when the detent wedge is engaged and received by the recessed area of a magazine. The small wedge end of the detent does not block the magazine from being inserted as the magazine slides along the face of the carrier and contacts the detent wedge.

The ridges or internal features of a carrier may also be wedge shaped so that a magazine being inserted is not blocked from sliding along the faces of a carrier. The magazine can engage the small end of the wedge that is closer to the open end of the carrier and displace the faces as the magazine contacts a larger section of the wedge. The carrier is made to flex by insertion of the magazine and the faces spread apart to receive the magazine. The faces of the carrier may be in a neutral position, free from flex, when engaged with a magazine and may rely only on the engagement between a detent and a recessed area of a magazine, the ridge and a longitudinal recess of a magazine, or the internal feature and an overhanging portion of a magazine to securely retain the magazine. Alternatively, the carrier may be made slightly smaller than the magazine so that a compressive force is additionally applied to the magazine.

The faces 11-14 of a magazine block the magazine from being laterally dislodged. The top face prevents the magazine from being displaced in the upper direction. The inside contours, e.g. detents, ridges, or inner features prevent the magazine from being dislodged in the downward direction. These elements cooperate to securely retain the magazine. Applying only lateral, upward, or downward force will not dislodge the magazine.

A multi-vectored force on the magazine is required to dislodge the magazine from the carrier. The magazine may be removed from the carrier by using the magazine as a lever to separate the discontiguous faces. The magazine is rotated rearward and pulled down, away from the top face. This movement causes the carrier to flex and spread apart and causes the carrier's inside contours to disengage from a magazine so that the magazine is no longer supported.

The carrier's flex provides the detent with a variable travel path. The travel path of the detent is the path along which the detent may travel as the face to which the detent is coupled flexes, pivots, rotates or is otherwise displaced by application of a non-destructive force. The travel path includes the path of engagement and disengagement with a magazine's recessed area. The flexible nature of the sides allows the detent to have a travel path that is non-linear.

Other multi-vectored movements may also be used to disengage the magazine from the carrier. The carrier may be positioned on the left hip with the ammunition facing forward. A marksman may use the left hand to grasp the magazine and pull it back and away from the third face. The grasp on the magazine need not be altered between removal of the magazine from the carrier and insertion of the magazine into a weapon's receiver well.

While the invention has been illustrated and described in detail in the drawings and foregoing description, the same is to be considered as illustrative and not restrictive in character. Reference to top, bottom, upward, or downward is intended to describe the relative orientations and does not limit actual use, orientation, or positioning of the carrier. Only the preferred embodiments have been shown and described and that all changes and modifications that come within the spirit of the invention are desired to be protected.

What is claimed:

1. A munitions magazine carrier comprising:

a first face;

a second face substantially perpendicular to said first face;

a third face substantially perpendicular to said second face; and a fourth face substantially perpendicular to said third face; and wherein the second face is contiguous with the first and third faces and is not contiguous with the fourth face;

wherein said faces form a rectangular structure adapted to substantially surround an outfeed end of a munitions magazine;

wherein the first and third faces each comprise a longitudinally extending ridge adapted to releasably engage the outfeed end of a munitions magazine;

wherein the first and third faces are adapted to flex away from each other when inserting or removing the outfeed end of a munitions magazine into or out of the munitions magazine carrier;

wherein the fourth face is adapted to flex away from the second face when inserting or removing the outfeed end of a munitions magazine into or out of the munitions magazine carrier;

wherein said faces are adapted to carry a munitions magazine until a user disengages the munitions magazine from the munitions magazine carrier by simultaneously: (1) flexing the first and third faces away from each other by using the munitions magazine as a lever; (2) flexing the fourth face away from the second face by rotating the munitions magazine toward the fourth face; and (3) pulling the munitions magazine out of the munitions magazine carrier.

2. The carrier of claim 1, further comprising:

a top contiguous with fewer than all of said first, second, third and fourth faces.

3. The carrier of claim 2, wherein said top is contiguous with said second and fourth faces.

4. The carrier of claim 1, further comprising:

a detent on one of said first, second, third and fourth faces.

5. The carrier of claim 1, wherein said longitudinally extending ridge is wedge-shaped.

6. The carrier of claim 1, wherein said first, second, and third faces are of a unibody construction.

7. The carrier of claim 6, further comprising a mounting stick coupled to one of said faces.

8. The carrier of claim 7, wherein said mounting stick is of unibody construction with said faces.

9. The carrier of claim 7, wherein said mounting stick is positioned and configured to mate with a retaining garment.

10. The carrier of claim 2, further comprising:

a detent; and wherein said detent, said top, and said first, second, third and fourth faces are of a unibody construction.

11. The carrier of claim 2, wherein said longitudinally extending ridges are perpendicular to said top.

12. The carrier of claim 2, having a means for supporting an overhanging portion of a magazine.

13. The carrier of claim 2, further comprising:

a mounting stick; and a fastener securing said mounting stick to one of said first, second, third and fourth faces.

14. The carrier of claim 13, wherein one of said first, second, third and fourth faces has only one fastener port through which said fastener passes, and wherein said fastener port is recessed from the interior of the carrier.

15. The carrier of claim 13, wherein one or more of said first, second, third and fourth faces has a plurality of fastener ports which are recessed from the interior of the carrier.

16. The carrier of claim 14, wherein a second of said first, second, third, and fourth faces has a second fastener port.

17. The carrier of claim 14, wherein said mounting stick has one or more fastener ports for receiving said fastener.

18. A method of using a munitions magazine carrier, comprising the steps of:

providing a munitions magazine carrier comprising:

a first face;

a second face substantially perpendicular to said first face;

a third face substantially perpendicular to said second face; and a fourth face substantially perpendicular to said third face; and wherein the second face is contiguous with the first and third faces and is not contiguous with the fourth face;

wherein said faces form a rectangular structure adapted to substantially surround an outfeed end of a munitions magazine;

wherein the first and third faces each comprise a longitudinally extending ridge adapted to releasably engage the outfeed end of a munitions magazine;

wherein the first and third faces are adapted to flex away from each other when inserting or removing the outfeed end of a munitions magazine into or out of the munitions magazine carrier;

wherein the fourth face is adapted to flex away from the second face when inserting or removing the outfeed end of a munitions magazine into or out of the munitions magazine carrier;

releasably securing a munitions magazine to the munitions magazine carrier by inserting an outfeed end of the munitions magazine between said faces until said longitudinally extending ridges releasably engage the outfeed end of the munitions magazine;

removing the munitions magazine from the munitions magazine carrier by simultaneously:

(1) flexing the first and third faces away from each other by using the munitions magazine as a lever;

(2) flexing the fourth face away from the second face by rotating the munitions magazine toward the fourth face; and (3) pulling the munitions magazine out of the munitions magazine carrier.

19. The method of claim 18, further comprising the step of removably attaching the munitions magazine carrier to a retaining garment.

* * * * *